United States Patent [19]

Merkel

[11] Patent Number: 4,955,533

[45] Date of Patent: Sep. 11, 1990

[54] SUPPORT AND PROTECTIVE STRUCTURE FOR A MAIL BOX

[75] Inventor: Gordon Merkel, Eagle River, Wis.

[73] Assignee: Boot Lake Industries, Inc., Arlington Heights, Ill.

[21] Appl. No.: 403,163

[22] Filed: Sep. 5, 1989

[51] Int. Cl.[5] ..... B65D 91/00

[52] U.S. Cl. ..... 232/39; 248/145

[58] Field of Search ..... 232/39, 17; 248/131, 248/145, 415, 159

[56] References Cited

U.S. PATENT DOCUMENTS

| | | | |
|---|---|---|---|
| 1,249,315 | 12/1917 | Brandvold | 248/145 |
| 1,508,052 | 9/1924 | Hastings | 248/145 |
| 1,584,085 | 5/1926 | England | 248/145 |
| 2,280,476 | 4/1942 | Calvert | 232/39 X |
| 2,605,073 | 7/1952 | Buck | 232/39 X |
| 3,881,650 | 5/1975 | Schmidt | 232/39 |
| 4,172,579 | 10/1979 | Steinman | 232/39 X |
| 4,187,978 | 2/1980 | Dowker | 232/39 |
| 4,286,747 | 9/1981 | Deike | 232/39 |

*Primary Examiner*—Robert W. Gibson, Jr.

*Attorney, Agent, or Firm*—Thomas R. Vigil

[57] ABSTRACT

The support and protective structure for a mailbox or other similar structure comprises a first pipe adapted to be driven into or implanted in the ground and having means at the upper end for rotatably mounting the lower end of a second pipe and a second pipe. The second pipe has a first pipe portion having a lower end which is adapted to be journaled to the upper end of the first pipe, the first pipe portion being adapted to extend generally upwardly from the upper end of the first pipe to a first elbow, a second pipe portion extending laterally outwardly from the first elbow in a generally horizontal direction generally laterally outwardly from the first pipe portion to an outer second elbow, and a third pipe portion extending laterally to the side from the second elbow and the second pipe portion to a third elbow, and a fourth pipe portion extending angularly from the third elbow in a direction toward the second pipe portion. The third elbow and the fourth pipe portion form a protective shield for protecting the mailbox. At least the second pipe portion provides a support for mounting a mailbox.

11 Claims, 1 Drawing Sheet

SUPPORT AND PROTECTIVE STRUCTURE FOR A MAIL BOX

BACKGROUND OF THE INVENTION

1. Field of the Invention

The present invention relates to a structure for supporting and protecting a mailbox. More specifically, the present invention relates to such a structure which is of simple construction comprising a first lower pipe and a second specially configured upper pipe mounted on the upper end of the lower pipe and adapted to provide support and protection to a mailbox mounted on the 2. Description of the Prior Art Heretofore various types of mail box supports and protective structures therefor have been proposed. Examples of such previously proposed mail box support and protective structures are disclosed in the following U.S. patents:

| U.S. Pat. No. | Patentee |
|---|---|
| 1,411,867 | Munson |
| 2,050,573 | Kammerich |
| 2,149,050 | Hajicek |
| 2,216,408 | Elmer |
| 2,911,174 | Goss |
| 3,870,262 | Manning, Jr. |
| 3,881,650 | Schmidt |
| 3,899,150 | Racquet |
| 4,130,239 | Belsheim |
| 4,187,978 | Dowker |
| 4,286,747 | Deike |
| 4,792,088 | Bonnell |

The Munson U.S. Pat. No. 1,411,867 discloses a swinging mail box which is connected by a rotatably journaled arm to a vertical pipe set in the ground. The arm is provided with curved side members which extend outwardly from the bottom of the mailbox and the rotatable arm and have outer end portions which can fold back toward the mailbox to provide some protection for same and which can be folded out to form a parcel receiving rack.

The Kammerich U.S. Pat. No. 2,050,573 merely discloses a mail box mounted at the end of a pipe that has an inner end adapted to be received on and rotatably journaled on a rod shaped base member. No protection for the mailbox is provided by this mailbox support.

Similarly, the Hajicek U.S. Pat. No. 2,149,050 discloses a rural mail box mounted on the upper end of a pipe which is adapted to be rotatably journaled to a lower pipe.

The Elmer U.S. Pat. No. 2,216,408 discloses a supporting device for a mailbox which includes an upper pipe rotatably journaled on a lower pipe, the upper pipe having an outer end which is flattened and which receives a bracket thereon having side walls. A mailbox is mounted on the bracket with the side walls providing some protection therefor.

The Goss U.S. Pat. No. 2,911,174 discloses a flexibly mounted mail box which is mounted for pivotable movement around the upper end of a pipe or post and the post is mounted to a base member by a bolt. The bolt permits the upper post to be rotated in a vertical plane about the axis of the bolt.

The Manning, Jr. U.S. Pat. No. 3,870,262 discloses a swingable, demountable mailbox support which also enables a mailbox to be pushed inwardly on a support but does not provide any protective structure for the mailbox itself.

The Schmidt U.S. Pat. No. 3,881,650 discloses an arch swingaway stand which includes a first post fixed in the ground and a second arcuate rod or pipe which has one end rotatably journaled to the upper end of the post and the other end being fixed to a platform or support on which are mounted one or more mailboxes. The one or more mailboxes are mounted centrally of the rectangularly shaped support or platform such that the ends of he support or platform provide some protection to the mailboxes since the ends will be hit first by a vehicle when the vehicle is traveling in the path of the mailbox.

The Racquet U.S. Pat. No. 3,899,150 discloses a self-righting mailbox support including a lower pipe that is fixed in the ground. A spring is mounted within the lower pipe at the upper end thereof and a plug having a cap is received in the upper end of the pipe and engages the spring. A mailbox support arm 17 is welded to the cap and extends laterally outwardly therefrom for mounting a mailbox. No protection is provided for the mailbox.

The Belsheim U.S. Pat. No. 4,130,239 discloses a swing-away mailbox which includes a bracket structure for mounting a mailbox which includes a pipe which is adapted to be rotatably mounted on an angularly extending rod mounted on the top of a post.

The Dowker U.S. Pat. No. 4,187,978 discloses a mailbox protective apparatus which includes a lower pipe. A rod or pipe is mounted in the lower pipe, is rotatable thereon and is connected by an elbow to a horizontally extending pipe extending from the elbow and having mounted thereon a U-in-cross-section protective structure having a flat central bight portion and upstanding wall portions. The wall portions on either side of the mailbox protect the mailbox when it is hit with an object.

The Deike U.S. Pat. No. 4,286,747 discloses a mail box support which provides some protection for mailboxes mounted thereon. The support includes a base support and means for rotatably mounting an upper specially configured pipe assembly to the base support permitting rotation of a lower portion of the pipe assembly which includes a lower portion that is connected to the base support and which preferably has a weakened fracture zone to facilitate breaking off of the pipe assembly when it is hit by a vehicle. The pipe assembly further includes a second portion which extends angularly upwardly at a small angle to the horizontal and a third portion which extends angularly upwardly at a larger angle to the horizontal and at a small angle to the vertical to a bend. An upper portion extends generally horizontally from the bend. Two or more mailboxes are mounted on the upper portion. The portion of the pipe assembly which forms a large angle to the horizontal and a small angle to the vertical is positioned to receive and absorb the impact of a motor vehicle which engages the assembly. No protection is provided for blows applied to the mailbox from the top thereof.

The Bonnell U.S. Pat. No. 4,792,088 discloses an indestructible mailbox which comprises a thick gauge cylindrical mailbox shell, a top pipe stem, a metal resilient spring and a bottom anchor post pipe stem having a circular drive auger. The top pipe stem is mounted on the spring and the spring is adapted to bend or rotate when the mailbox is hit with an object.

As will be described in detail hereinafter, the mailbox support and protective structure of the present invention differs from the previously proposed mailbox support and protective structures by providing a simple two pipe assembly where the second pipe extends upwardly and laterally or horizontally outwardly, laterally to one side, and then laterally rearwardly, angularly and/or upwardly, to provide a protective elbow and pipe arm which can be configured to protect the mailbox from blows from the top, as well as from the side. Also, the configuration of the upper second pipe as just described enables the upper pipe to be rotated on a lower pipe that is driven into or implanted in the ground so that the protective end portion of the pipe which is shaped to protect the sides and/or top of the mailbox from blows by an object, the outer portion of the second upper pipe mounting the mailbox will be rotated about the axis of the first pipe driven into or implanted in the ground. The two pipes are very simple in construction and provide a simple and inexpensive mailbox protective and support assembly.

SUMMARY OF THE INVENTION

According to the present invention, there is provided a mailbox support and protective structure for a mailbox or similar structure comprising a first pipe adapted to be driven into or implanted in the ground and having means at the upper end for rotatably mounting the lower end of a second pipe, a second pipe having a first pipe portion having a lower end which is adapted to be journaled to the upper end of said first pipe, said first pipe portion being adapted to extend generally upwardly from the upper end of said first pipe to a first elbow, a second pipe portion extending laterally outwardly from said first elbow in a generally horizontal direction generally laterally outwardly from said first pipe portion to an outer second elbow, and a third pipe portion extending laterally to the side from said second elbow and said second pipe portion to a third elbow, and a fourth pipe portion extending angularly from said third elbow in a direction toward said second pipe portion, said third elbow and said fourth pipe portion forming a protective shield for protecting the mailbox, at least said second pipe portion providing a support for mounting a mailbox.

DESCRIPTION OF THE PREFERRED EMBODIMENT

Figure 1:
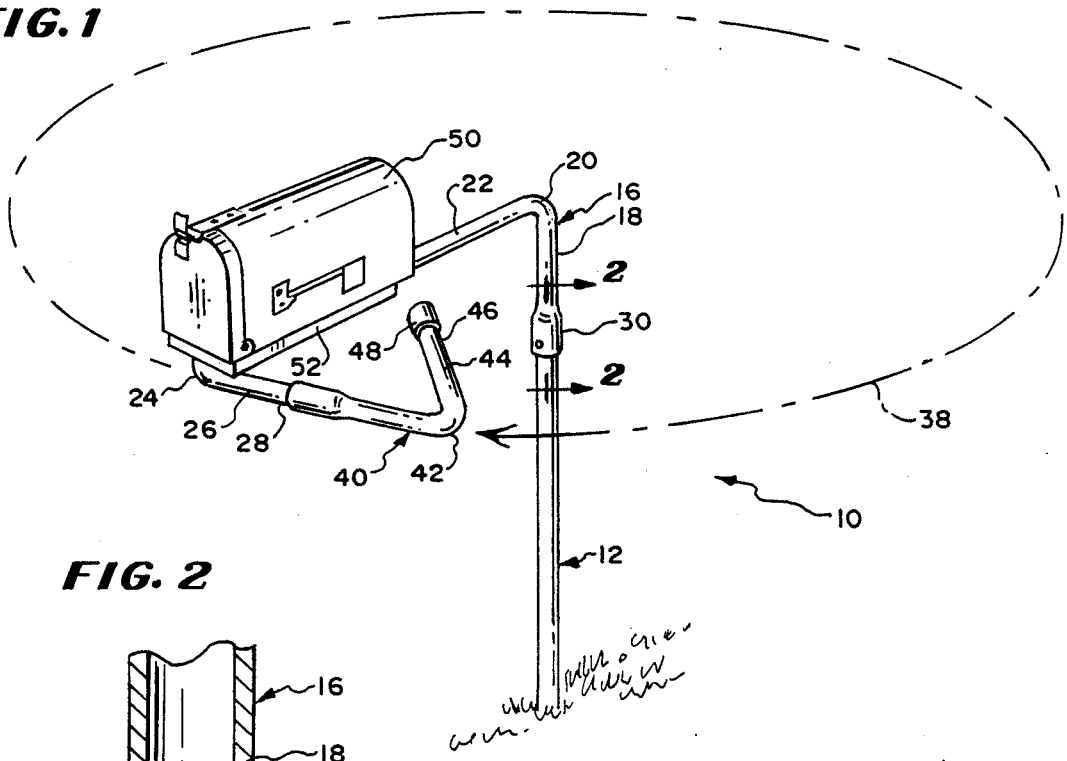
FIG. 1 is a perspective view of a mailbox support and protective structure with a mailbox mounted thereon and constructed according to the teachings of the present invention.

Referring to the drawings in greater detail, there is illustrated in FIG. 1 a mailbox support and protective structure 10 which is inexpensive and of simple construction. The structure 10 comprises a first lower straight pipe 12 which is adapted to be driven into or implanted in the ground and which has a flared upper end 14 as shown in FIG. 2.

The support and protective structure 10 further includes at least one upper second pipe 16 having a first pipe portion 18 adapted to extend vertically upwardly to a first elbow 20, a second pipe portion 22 which is adapted to extend horizontally outwardly from said first elbow 20 to a second elbow 24, and a third pipe portion 26 which extends laterally outwardly from said second elbow 24 to an end 28.

Figure 2:
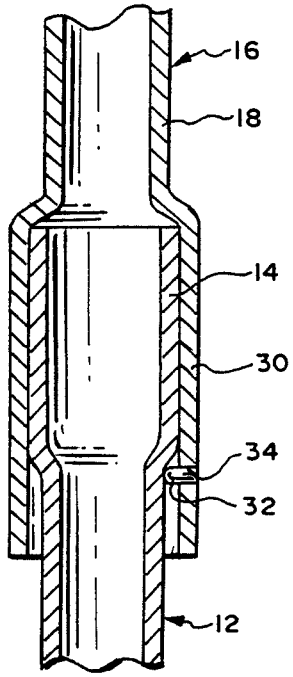
FIG. 2 is a longitudinal sectional view through the inner connection between the upper and lower pipes of the support and protective structure.

The first pipe portion 18 has a lower end 30 which can be flared, as shown, and which is adapted to be received over the flared upper 14 end of the first pipe 12 and once assembled in this manner, the second pipe 16 can be rotatably fixed to the flared upper end 14 of the first pipe 12 by means of a pin 32 driven through a hole 34 just above the bottom 36 of the lower flared end 30 of the first pipe portion 18 of the second pipe 16 and just below the flared end 14 of the first pipe 12 as shown in FIG. 2.

This connection of the flared end 30 of the second pipe 16 received over the flared end 14 of the first pipe 12 allows the upper second pipe 16 to be rotated about the vertical axis of the first pipe 12 as indicated by the dashed lines 38 in FIG. 1.

In the embodiment of the structure 10 shown in FIG. 1 a third pipe 40 is fixed to and extends outwardly from the end 28 of the third pipe portion 26 of the second pipe 16 to a third elbow 42 and then has an end portion 44 which extends at an angle horizontally and rearwardly toward the second pipe portion 22 of the second pipe 16. The third pipe 40 is shown as a separate pipe but can be integral with and an extension of the third pipe portion 26 of the second pipe 16.

An outer free end 46 of the third pipe 40 is preferably covered with a cap 48 as shown.

The elbow 42 and end portion 44 provide a shield which will be engaged by a vehicle that comes too close to a mailbox 50 mounted on the second pipe portion 22 of the second pipe 16 to prevent damage to same.

The mailbox 50 is preferably mounted on a generally rectangular wooden baseboard 52 which in turn is bolted by bolts and nuts (not shown) extending through the second pipe portion 22 of the second pipe 16 and through the baseboard 52.

Figure 3:
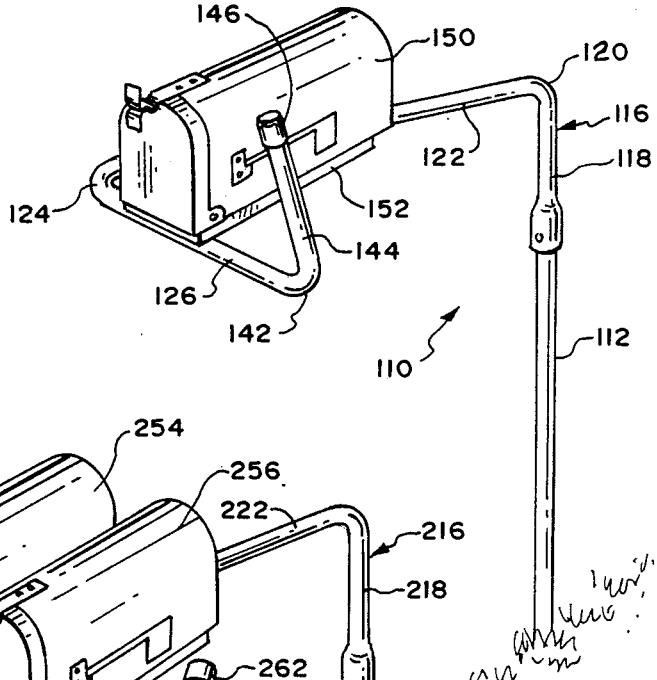
FIG. 3 is a perspective view of another embodiment of the mailbox support and protective structure mounting a single mailbox.

As shown in FIG. 3, one preferred embodiment of a mailbox support and protective structure 110 constructed according to the teachings of the present invention comprises a first pipe 112 identical to the first pipe 12 shown in FIG. 1 and a second pipe 116 which has a first pipe portion 118, a first elbow 120, and a second pipe portion 122 substantially identical to the first and second pipe portions 18 and 22 of the second pipe 16 shown in FIG. 1. In this embodiment, the second pipe portion 122 can be the same length or longer than the second pipe portion 22 shown in FIG. 1. The second pipe 116 then includes a third pipe portion 126 which extends laterally horizontally from a second elbow 124 at the outer end of the second pipe portion 122 to a third elbow 142 and then includes an end portion 144 which extends upwardly and angularly toward a vertical plane containing the second pipe portion 122 of the second pipe 116.

In this embodiment of the structure 110, a mailbox 150 mounted on a baseboard 152 is supported on the second and third pipe portions 122 and 126 of the second pipe 116 as shown. For this purpose, at least one bolt (not shown) will extend through the second pipe portion 122 and the baseboard 152 for mounting the baseboard 152 and mailbox 150 to the second pipe portion 122 and at least one bolt (not shown) will extend through the third pipe portion 126 and the baseboard 152 for mounting the baseboard 152 to the third pipe portion 126 of the second pipe 116.

This structure 110 with an end portion 144 of the second pipe 116 extending angularly upwardly to a capped end 146 may provide more protection to the mailbox. In this respect, a vandal holding or swinging an object such as a baseball bat or crowbar at the mailbox while riding in a vehicle passing by the mailbox would hit the upstanding end pipe portion 144 thereby preventing damage to the mailbox 150.

Figure 4:
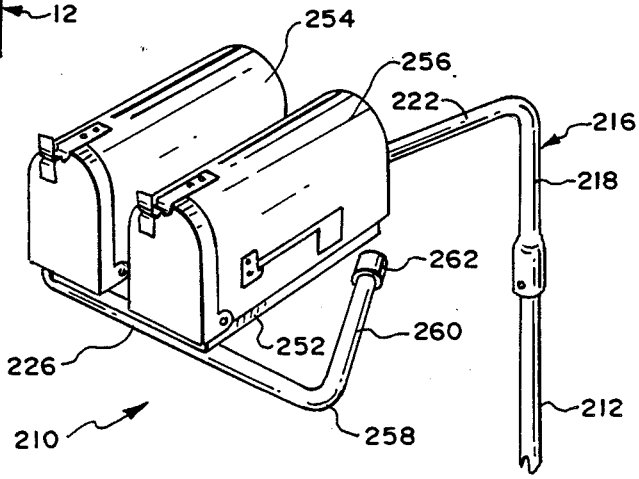
FIG. 4 is a perspective view of still another embodiment of the mailbox support and protective structure mounting two mailboxes.

In FIG. 4 there is shown still another embodiment of a mailbox support and protective structure 210 constructed in accordance with the teachings of the present invention. The structure 210 includes a first pipe 212 identical to the first pipe 12 shown in FIG. 1 and a second pipe 216 which has a first pipe portion 218, a second pipe portion 222 and a third pipe portion 226 substantially identical to the first, second and third pipe portions 110, 122, and 126 of the second pipe 116 shown in FIG. 3, except that the third pipe portion 226 can be the same length or longer than the third pipe portion 126 shown in FIG. 3 so that a generally rectangular baseboard 252 mounting two mailboxes 254 and 256 can be supported upon and fixed to the second and third pipe portions 222 and 226 by suitable fastening means, such as bolts. The mailboxes 254 and 256 can be mounted on separate boards and supported by one or two additional pipes extending between second pipe portion 222 and pipe portion 260.

In this embodiment, the third pipe portion 226 extends to an elbow 258 and an end or fourth pipe portion 260 extends to a capped end 262 angularly rearwardly and upwardly toward the mailboxes 254, 256.

From the foregoing description, it will be apparent that the mailbox support and protective structures 10, 110 or 210 have a number of advantages some of which have been described above and others of which are inherent in the invention. For example, the structures 10, 110 and 210 are very simple in construction, comprising a minimum of two specially configured pipes 12, 16; 112, 126; or 212, 216. Additionally, the structures 10, 110 or 210 can include a pin 32 for locking the pipes 12, 16; 112, 116; or 212, 216 in a rotatably journaled condition and an end cap 44.

The structures 10, 110 and 210 then can also include a mailbox mounting baseboard 52, 152 or 252 and if desired a third pipe.

The cantilever construction of the mailbox support and protective structure 10, 110 or 210 with the bends and swivel joint described above and its durable pipe construction of 16 gauge steel provides protection and convenience of use.

These structures 10, 110 and 210 are particularly adapted for use in areas susceptible to heavy damage such as cul-de-sacs, turns, dead-ends, curves, roads with no curbs, heavily used roadways, regions that receive heavy snow fall and heavily vandalized areas. Once a structure 10, 110 or 210 is struck and out of place, it can be easily retrieved.

The structure 10 offers excellent protection. The guard bar 44, 144 or 260 and swing away feature protects against snow-plow and vehicle collisions as well as the problem of excessive snow piled around the mailbox.

The structure 110 provides the same benefits of the structure 10. The protective bar 144 makes it nearly impossible to strike the mailbox 150 from a moving vehicle.

The structure 210 provides a protective and attractive structure for supporting multiple mailboxes. It offers the same protection as the structure 10 and has an option available which offers the same protection as the structure 110.

Also, it will be understood from the foregoing description that modifications can be made to the mailbox support and protective structures 10, 110 and 210 of the present invention without departing from the teachings of the present invention. Accordingly, the scope of the invention is only to be limited as necessitated by the accompanying claims.

I claim

1. A support and protective structure for a mailbox or other similar structure, comprising a first pipe adapted to be driven into or implanted in the ground and having means at the upper end for rotatably mounting the lower end of a second pipe, a second pipe having a first pipe portion having a lower end which is adapted to be journaled to the upper end of said first pipe, said first pipe portion being adapted to extend generally upwardly from the upper end of said first pipe to a first elbow, a second pipe portion extending laterally outwardly from said first elbow in a generally horizontal direction generally laterally outwardly from said first pipe portion to an outer second elbow, and a third pipe portion extending laterally to the side from said second elbow and said second pipe portion to a third elbow, and a fourth pipe portion extending angularly from said third elbow in a direction toward said second pipe portion, said third elbow and said fourth pipe portion forming a protective shield for protecting the mailbox, at least said second pipe portion providing a support for mounting a mailbox.

2. The structure of claim 1 wherein said upper end of said first pipe is flared outwardly and the lower end of said first pipe portion of said second pipe is also flared outwardly and sized to fit over said flared upper end of said first pipe.

3. The structure of claim 2 wherein said outwardly flared lower end of said first portion of said second pipe has a hole therethrough located beneath the flared upper end of said first pipe when said flared lower end of said first portion of said second pipe is received thereover and a pin is received in said hole and inside said second pipe for preventing said flared end portion at the lower end of said first pipe portion of said second pipe from being pulled upwardly while yet allowing rotation of said flared lower end of said first pipe portion of said second pipe on said flared upper end of said first pipe.

4. The structure of claim 1 wherein said first, second, third and fourth pipe portions of said second pipe are portions of one integral pipe.

5. The structure of claim 1 wherein an outer part of said third pipe and said fourth pipe are an integral piece having an inner end which is fixed to an outer end of an inner part of said third pipe portion.

6. The structure of claim 1 wherein the outer end of said fourth pipe portion of said second pipe has a cap thereon.

7. The structure of claim 1 wherein said second and third pipe portions of said second pipe are configured, sized and arranged to support a mailbox thereon.

8. The structure of claim 1 wherein said second and third pipe portions of said second pipe are configured, sized and arranged to support a baseboard mounting two mailboxes thereon.

9. The structure of claim 1 wherein said fourth pipe portion extends from said second elbow generally rearwardly in approximately the same plane as the second and third pipe portions and toward said second pipe portion.

10. The structure of claim 1 wherein said fourth pipe portion extends from said second elbow generally upwardly in a generally upright plane including the third pipe portion and said fourth pipe portion.

11. The structure of claim 1 wherein said fourth pipe portion extends both rearwardly and upwardly from said third elbow in a direction generally toward said second pipe portion and toward a mailbox mounted on said second pipe.

* * * * *